US009919409B2

(12) United States Patent
Schomisch et al.

(10) Patent No.: US 9,919,409 B2
(45) Date of Patent: Mar. 20, 2018

(54) ELECTRIC POWER TOOL HAVING A SWITCHING DEVICE

(71) Applicant: Robert Bosch GmbH, Stuttgart (DE)

(72) Inventors: Thomas Schomisch, Filderstadt (DE); Manfred Lutz, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 437 days.

(21) Appl. No.: 14/644,648

(22) Filed: Mar. 11, 2015

(65) Prior Publication Data

US 2015/0290790 A1 Oct. 15, 2015

(30) Foreign Application Priority Data

Apr. 11, 2014 (DE) ..... 10 2014 207 048

(51) Int. Cl.
*B25F 5/00* (2006.01)

(52) U.S. Cl.
CPC ..... *B25F 5/00* (2013.01)

(58) Field of Classification Search
CPC ..... H01H 9/00; F16D 63/006; B23D 49/162; B23D 51/16; B25F 5/001
USPC ..... 173/1, 170; 200/157, 153 T, 330
See application file for complete search history.

(56) References Cited

U.S. PATENT DOCUMENTS 4,280,026 A * 7/1981 Alessio ..... H01H 3/20 200/321
4,380,693 A * 4/1983 Kuhlmann ..... H01H 9/06 200/321
4,520,256 A * 5/1985 Doyle ..... A45D 1/04 132/232
4,592,144 A * 6/1986 Tolbert ..... B23D 49/167 200/291

* cited by examiner

*Primary Examiner* — Nathaniel Chukwurah
(74) *Attorney, Agent, or Firm* — Maginot, Moore & Beck LLP

(57) ABSTRACT

An electric power tool has a tool housing and a drive motor configured to drive an insert tool. The drive motor is switched on and off by an electric switch actuated by a switching device. The switching device has at least one switching slide with a first end and a second end. The first end has a receiver configured to receive an operating element. The second end is connected to an actuating element configured to actuate the electric switch. The receiver has a first region that tapers into a second region. The operating element has a connecting web connected to a holding element. The holding element has an extent that is less than or equal to an assigned extent of the first region. The connecting web has an extent that is less than or equal to an assigned extent of the second region.

16 Claims, 9 Drawing Sheets

ELECTRIC POWER TOOL HAVING A SWITCHING DEVICE

This application claims priority under 35 U.S.C. § 119 to patent application number DE 10 2014 207 048.1, filed on Apr. 11, 2014 in Germany, the disclosure of which is incorporated herein by reference in its entirety.

BACKGROUND

The disclosure relates to an electric power tool, having a tool housing, arranged in which there is a drive motor, which can be switched on and off by means of an electric switch, for driving an assigned insert tool, a switching device being provided to actuate the electric switch, which switching device has at least one switching slide that is arranged in a longitudinally displaceable manner on the tool housing and that, at a first axial end, is provided with at least one receiver for receiving an operating element, at least portionally, and at a second axial end opposite to the first axial end is connected to an actuating element for actuating the electric switch.

Such an electric power tool is known from the prior art, having a switching device for actuating an electric switch, in which the switching device has an operating element arranged on a switching slide. This operating element is fastened to the switching slide by means of a snap-action hook.

A disadvantage of this prior art is that the fastening of the operating element to the switching slide by means of the snap-action hook has only a limited stability. Under the action of an externally applied force that may act upon the operating element or the switching slide, e.g. if the electric power tool falls down, the operating element may separate from the switching slide, in which case, or as a result of which, the snap-action hook may become damaged or destroyed.

SUMMARY

It is therefore an object of the disclosure to provide a new electric power tool having a switching device that has a switching slide and an operating element, and with which the operating element can be connected to the switching slide in a reliable and stable manner.

This problem is solved by an electric power tool having a tool housing, arranged in which there is a drive motor, which can be switched on and off by means of an electric switch, for driving an assigned insert tool, a switching device being provided to actuate the electric switch, which switching device has at least one switching slide that is arranged in a longitudinally displaceable manner on the tool housing and that, at a first axial end, is provided with at least one receiver for receiving an operating element, at least portionally, and at a second axial end opposite to the first axial end is connected to an actuating element for actuating the electric switch. The at least one receiver has at least one first region that tapers into at least one second region, and at least one connecting web, which is connected to at least one holding element, is realized on the operating element, the holding element having, in the transverse direction of the operating element, an extent that is less than or equal to an assigned extent of the first region, and the connecting web having, in the transverse direction of the operating element, an extent that is less than or equal to an assigned extent of the second region.

The disclosure thus makes it possible to provide an electric power tool having a switching device, with which it is possible to achieve a reliable and stable connection of the operating element to the switching slide by means of the configuration, according to the disclosure, of the receiver of the switching slide and of the holding element of the operating element.

Preferably, the extent of the holding element is greater than the extent of the second region.

The holding element can thus be easily blocked on the switching slide.

The at least one connecting web and the at least one holding element are preferably realized, at least approximately in the shape of a T, on a side of the operating element that faces toward the tool housing.

It is thus made possible for the operating element, provided with the at least one connecting web and the at least one holding element, to be realized in an uncomplicated manner that is suitable for large-scale production.

The at least one connecting web and the at least one holding element are preferably realized so as to be integral with the operating element.

It is thus possible to provide a robust and stable operating element having at least one connecting web and at least one holding element.

Preferably, an end stop is provided to limit the travel of the switching device during switch-on and/or switch-off of the drive motor.

It is thus made possible to provide a safe and reliable switching device that cannot reach an original mounting position during switch-on and/or switch-off of the drive motor, such that unintentional demounting of the switching device can be prevented in a safe and reliable manner.

According to one embodiment, an anti-rotation means is provided, which is realized at least to limit rotation of the operating element on the tool housing.

This enables the operating element to be guided on the tool housing in a simple and precise manner.

The tool housing preferably has an opening, in which the at least one connecting web is arranged, at least partially, the opening having at least one first and one second region, and an extent of the second region, in the transverse direction of the tool housing, and the extent of the at least one connecting web, in the transverse direction of the operating element, realizing a joint clearance to protect against rotation.

This enables the operating element to be guided on the tool housing in an uncomplicated and exact manner.

Preferably, the opening and the at least one receiver have at least approximately matching dimensions.

The operating element can thus be mounted in a rapid and uncomplicated manner.

The switching slide and the operating element preferably have a coding for mounting in the correct position.

This makes it easy to mount the operating element in the correct position on the switching slide.

According to one embodiment, the coding has at least one width asymmetry and/or geometric asymmetry.

It is thus made possible to provide an uncomplicated coding.

A side of the operating element that faces toward the tool housing preferably has at least one extent that has a curved cross section.

The operating element can thus be moved comparatively easily on the tool housing, and the electric power tool can thus be switched on and off in a comparatively convenient manner.

Preferably, a restoring spring is provided, which is realized to exert a restoring force upon the switching device, in order to prevent the operating element from separating from the switching slide.

Unintentional demounting of the operating element from the switching slide can thus be prevented in a safe and reliable manner.

The restoring spring is preferably integrated into the electric switch.

It is thus possible to make use of a restoring spring that is already present in the electric switch.

The restoring spring is preferably connected to the switching slide and the tool housing.

The restoring spring can thus be arranged in the electric power tool in a simple and uncomplicated manner.

BRIEF DESCRIPTION OF THE DRAWINGS

The disclosure is explained more fully in the description that follows, on the basis of exemplary embodiments represented in the drawings.

There are shown in.

DETAILED DESCRIPTION

Figure 1:
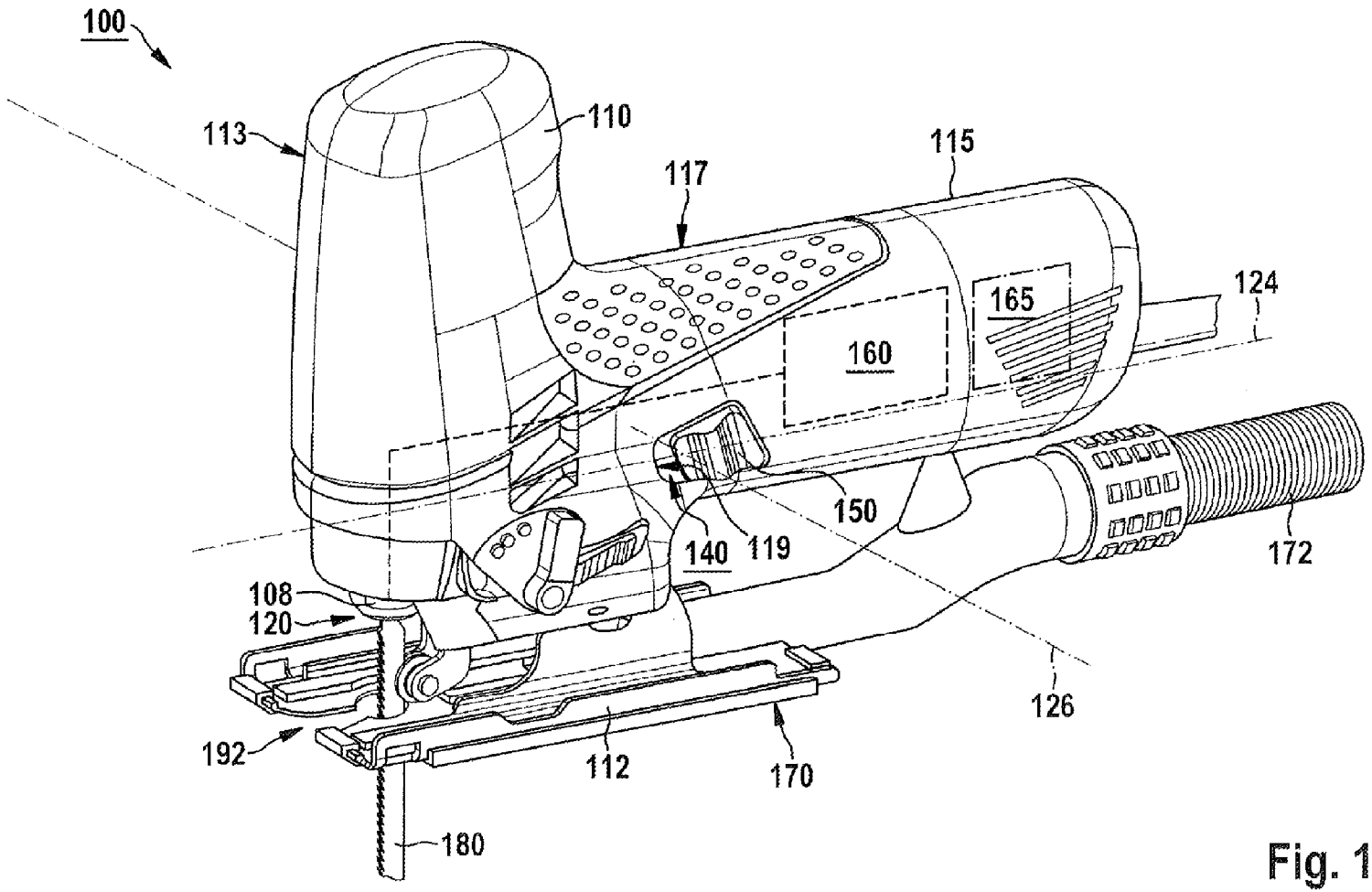
FIG. 1 a perspective view of an electric power tool, having a tool housing and a switching device, according to the present disclosure, FIG. 2 a longitudinal section through the electric power tool from FIG. 1, FIG. 3 a perspective view of the tool housing from FIG. 1, FIG. 4 a perspective view of a switching slide of the switching device from FIG. 1, FIG. 5 a perspective view of an operating element of the switching device from FIG. 1, FIG. 6 a perspective view of a first variant of an anti-rotation means of the switching device from FIG. 1, FIG. 7 a perspective view of a second variant of the anti-rotation means of the switching device from FIG. 1, FIG. 8*a* a schematic longitudinal section through the switching device and the tool housing from FIG. 1, during mounting, FIG. 8*b* a schematic side view of the arrangement from FIG. 8*a*, FIG. 9*a* a schematic longitudinal section through the switching device and the tool housing from FIG. 1, following mounting, in an off position, FIG. 9*b* a schematic side view of the arrangement from FIG. 9*a*, FIG. 10*a* a schematic longitudinal section through the switching device and the tool housing from FIG. 1, following mounting, in an on position, FIG. 10*b* a schematic side view of the arrangement from FIG. 10*a*, FIG. 11 a schematic side view of the switching device from FIG. 1 when mounted on the tool housing from FIG. 1, in the off position, FIG. 12 a schematic side view of the switching device from FIG. 1 when mounted on the tool housing from FIG. 1, in the on position, FIG. 13 a schematic side view of the switching device from FIG. 1 when mounted on the tool housing from FIG. 1, in the off position, with an end stop, FIG. 14 a schematic side view of the switching device from FIG. 1 when mounted on the tool housing from FIG. 1, in the off position, before mounting of the operating element from FIG. 1, FIG. 15 a schematic side view of the switching device from FIG. 1 when mounted on the tool housing from FIG. 1, in the off position, during mounting of the operating element from FIG. 1, FIG. 16 a perspective view of an operating element of the switching device from FIG. 1, with a coding, FIG. 17 a schematic view of a recess of the tool housing from FIG. 1, with a coding, and FIG. 18 a perspective view of an operating element of the switching device from FIG. 1, according to a further embodiment.

FIG. 1 shows an electric power tool 100, provided with a tool housing 110, according to the present disclosure. The tool housing 110 preferably constitutes a handle 115, at least portionally, provided on which, illustratively, there is a rubberized gripping surface 117; in addition, however, at least one further gripping region 113 may also be realized. A switching device 150 is preferably provided on a side 119 of the housing of the handle 115, which side of the housing, illustratively, has a longitudinal axis 124 and a transverse axis 126. This switching device, according to one embodiment, is realized to actuate a drive motor 160 that can be switched on and off by means of an electric switch 165.

The electric power tool 100 is realized, illustratively, in the manner of a hand-guided jigsaw or pendulum-action jigsaw, wherein the drive motor 160 may be any type of motor, e.g. an electrically commutated motor or a direct-current motor. The drive motor 160 serves to drive an output shaft 108, which has or is connected to, for example, a tool receiver 120, and which serves to receive an insert tool 180 that can be driven with a stroke motion, e.g. a saw blade. The latter is arranged, exemplarily, at least approximately perpendicularly in relation to a base plate 112 attached to the tool housing 110 and, illustratively, extends through an opening 192 provided in the base plate 112. Additionally arranged on the base plate 112, exemplarily, is an optional suction extraction device 170, which is provided with a suction extraction hose 172.

However, it is pointed out that, from the prior art, persons skilled in the art are sufficiently familiar with an operating principle and configuration of a suitable drive motor, or of a suitable jigsaw or pendulum-action jigsaw. For reasons of simplicity and conciseness of the description, therefore, these are not described further here. Moreover, it is pointed out that the present disclosure is not limited to hand-guided jigsaws or pendulum-action jigsaws that can be operated in dependence on a mains electric power supply, but instead can be applied, quite generally, in the case of electric power tools that can be operated in dependence on a mains electric power supply or independently thereof, e.g. with an associated battery pack, having a switching device according to the disclosure for switching on and switching off an associated drive motor, e.g. in the case of a polisher, a sander, a router, rod saw, etc. Furthermore, the present disclosure can also be used in the case of hand-held power tools that can be operated non-electrically and that can be switched on and off by means of a switching device according to the disclosure.

According to one embodiment, the switching device 150 has an assigned anti-rotation means 140. The latter is realized at least to limit, preferably to prevent, rotation of an operating element (210 in FIG. 2), assigned to the switching device 150, on the tool housing 110.

Figure 2:
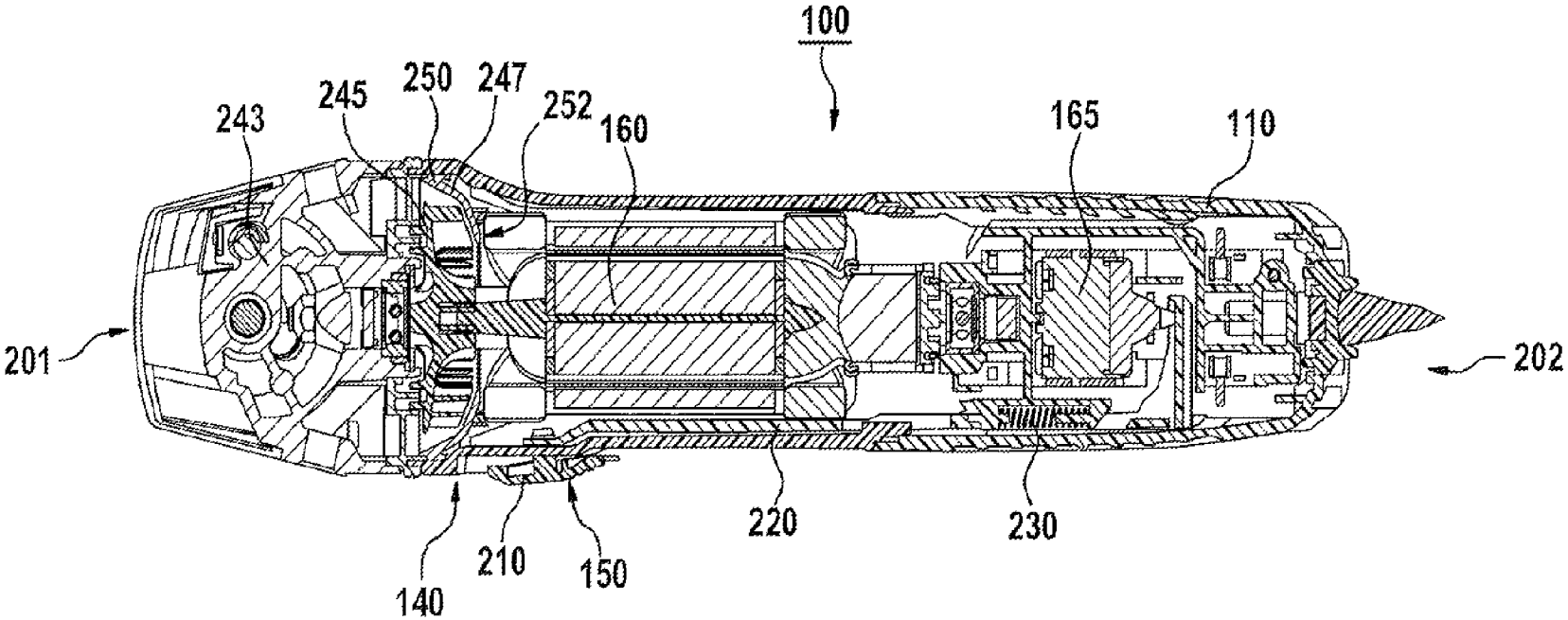

FIG. 2 shows the electric power tool 100 from FIG. 1, which exemplarily has a first and a second axial end 201, 202. An armature 243 having a fan 245 is preferably arranged in the tool housing 110, at the first axial end 201. The fan 245 has an assigned air guide ring 247 that, with its side 252 that faces away from the fan 245, constitutes an end stop 250 for the switching device 150, according to one embodiment. The end stop 250 serves to limit the travel of the switching device 150 during switch-on and/or switch-off of the drive motor 160, and thus preferably to limit a respective travel of a switching slide 220 assigned to the switching device 150, in such a manner that an assigned mounting position of the switching device 150 cannot be reached during operation, and automatic demounting of the switching device 150 can thus be prevented in a safe and reliable manner.

According to one embodiment of the switching device 150, the latter comprises at least the switching slide 220, which is arranged in a longitudinally displaceable manner on the tool housing 110, and which is preferably connected to an operating element 210 in a separable manner, and on which an actuating element (420 in FIG. 4) is provided for actuating the electric switch 165. Furthermore, arranged in the tool housing 110 there is a restoring spring 230, which is realized to exert a restoring force upon the switching device 150, in order to prevent the operating element 210, connected to the switching slide 220, from separating from the switching slide 220. Preferably, this restoring spring 230 is connected to the switching slide 220 and/or to the tool housing 110. As an alternative or in addition to this, it is also possible to use a restoring spring (610 in FIG. 8*b*) that is arranged, for example, in the electric switch 165. Moreover, the restoring spring 230 may also be arranged parallel to this restoring spring (610 in FIG. 8*b*) and preferably support the latter.

Figure 3:
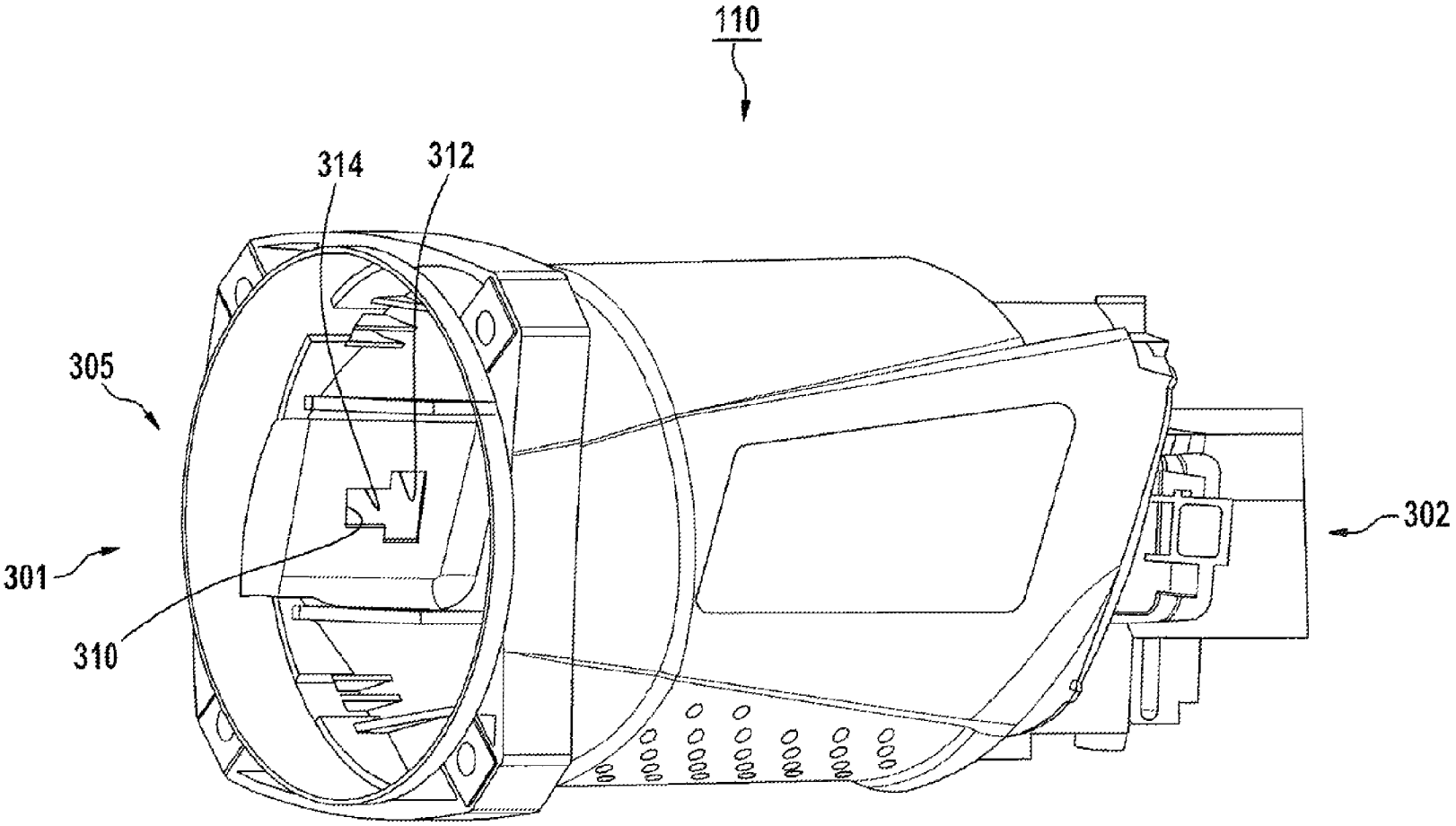

FIG. 3 shows the tool housing 110 from FIG. 1, preferably realized in the form of a cylinder, which has an opening 310 at least in the region of the side 119 of the housing from FIG. 1, or in a transverse direction 305 of the tool housing 110. According to one embodiment, this opening 310 has at least one first region 312 that tapers into a second region 314, the first region 312 of the opening 310 preferably facing toward a first axial end 301 of the tool housing 110, and the second region 314 facing toward a second axial end 302 of the tool housing 110. Preferably, the first and the second axial ends 301, 302 are arranged in a manner similar to the first and the second axial end 201, 202 of the electric power tool 100.

Figure 4:
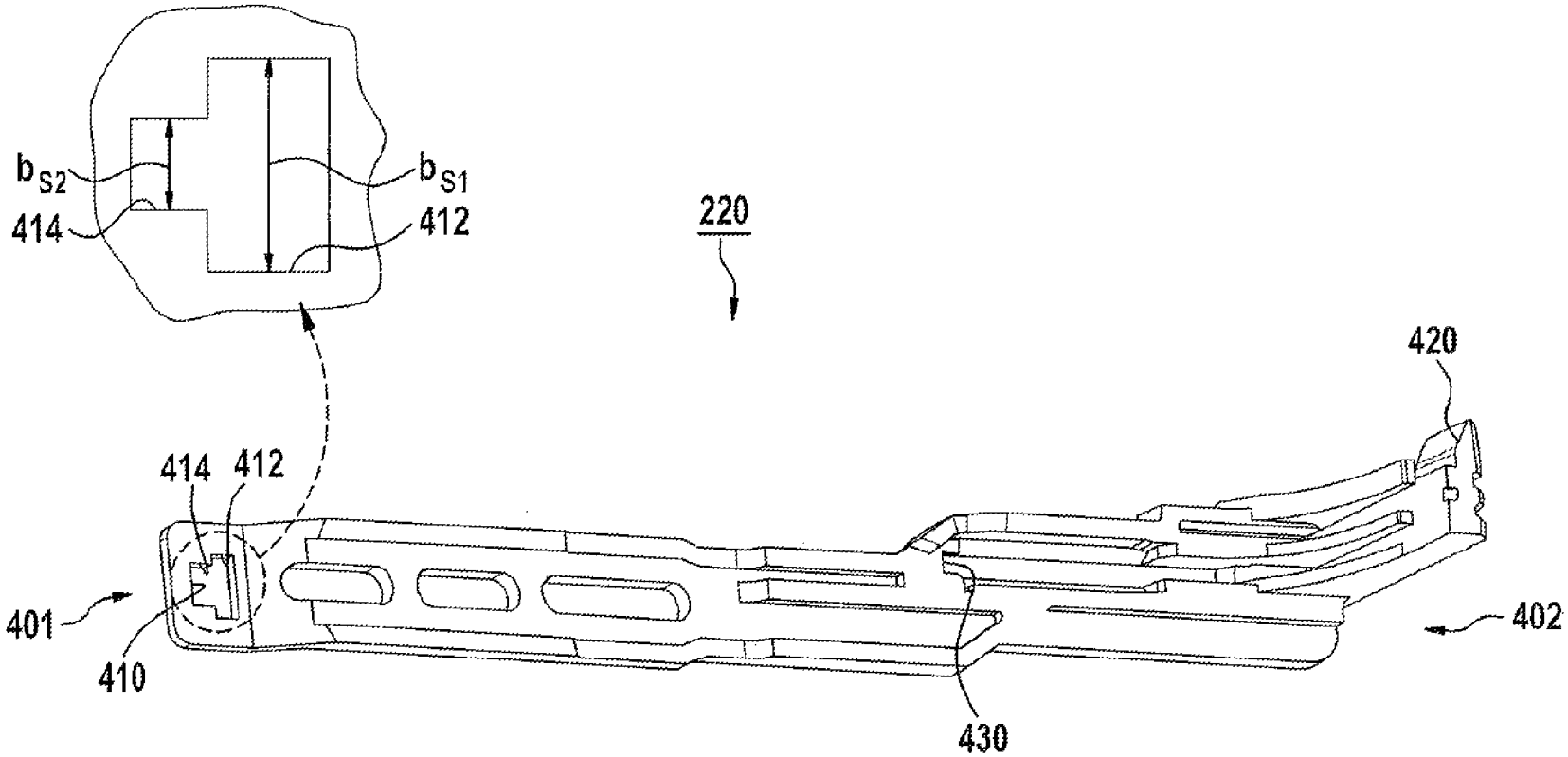

FIG. 4 shows the switching slide 220 from FIG. 2, which is preferably realized in an L shape, and which preferably, at a first axial end 401, is provided with at least one receiver 410 for receiving, at least portionally, the operating element 210 from FIG. 2. At a second axial end 402 that is opposite to the first axial end 401, the switching slide 220 is preferably connected to an actuating element 420, for the purpose of actuating the electric switch 165 from FIG. 2.

According to one embodiment, the at least one receiver 410, which in FIG. 4, illustratively, is additionally represented in a detail enlargement, has at least one first region 412, having preferably an assigned extent bS1 that tapers into at least one second region 414 having an assigned extent bS2. The second region 414 faces toward the first axial end 401, and the first region 412 faces toward the second axial end 402. Preferably, the extents bS1, bS2 are realized as widths of the opening 410, or of the first and the second region 412, 414 thereof.

Preferably, the at least one receiver 410 and the opening 310 of the tool housing 110 from FIG. 3 have at least approximately matching dimensions. Furthermore, the switching slide 220 preferably has an optional receiver 430 for receiving the restoring spring 230 from FIG. 2, at least partially.

Figure 5:
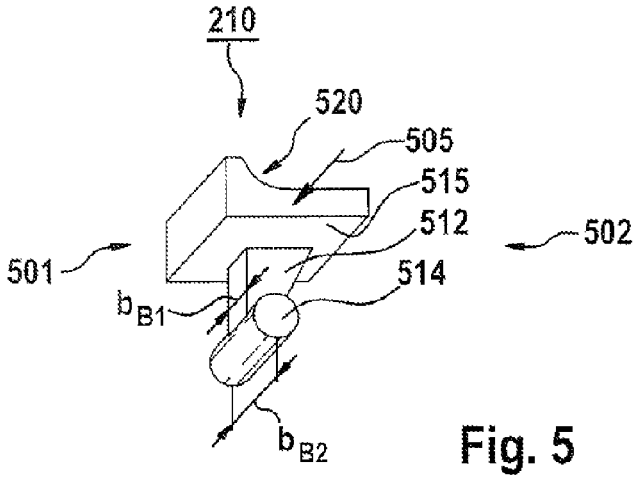

FIG. 5 shows the operating element 210 from FIG. 2, having a first and a second axial end 501, 502 and, at the first axial end 501, preferably having an illustratively curved actuating region 520. Realized on an underside 515 of the operating element 210 there is preferably at least one connecting web 512, which is connected to at least one holding element 514. Preferably, the holding element 514, in a transverse direction 505 of the operating element 210, has an extent bB2 that is preferably less than or equal to the assigned extent bS1 of the first region 414 from FIG. 4. According to one embodiment, the connecting web 512, in a transverse direction of the operating element 210 that is denoted by the reference 505, has an extent bB1 that is preferably less than or equal to the assigned extent bS2 of the second region 412 from FIG. 4.

Preferably, the extents bB1, bB2 in the transverse direction 505 are realized as a width of the connecting web 512, or of the holding element 514. Preferably, the at least one connecting web 512 and the at least one holding element 514 are realized at least approximately in the shape of a T and/or such that they are integral with the operating element 210.

Figure 6:
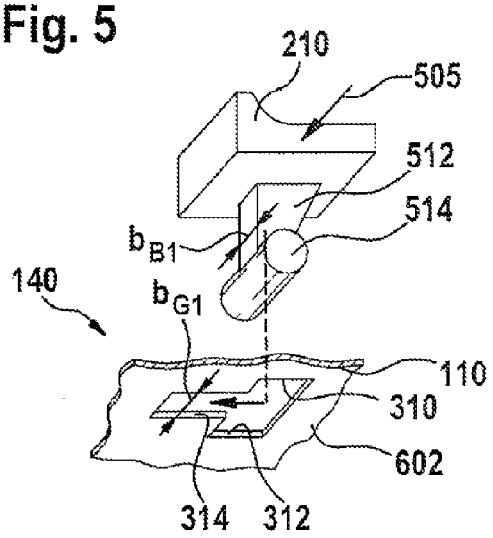

FIG. 6 shows the anti-rotation means 140 from FIG. 1, realized according to a first embodiment, in which the opening 310 of the tool housing 110 from FIG. 3 is realized in such a manner that the at least one connecting web 512 from FIG. 5 can be arranged therein, at least portionally. Preferably in this case, an extent bG1 of the second region 314 of the opening 310 from FIG. 3, preferably realized as a width, in the transverse direction 305 of the tool housing 110, and the extent bB1 of the at least one connecting web 512, in the transverse direction 505 of the operating element 210, realize a joint clearance to protect against rotation.

During mounting, the holding element 514 of the operating element 210 is first inserted through the first region 312 of the opening 310 of the tool housing 110 from FIG. 3, and through the first region 412 of the opening 410 of the switching slide 220 from FIG. 4, such that the holding element 514 is arranged on an underside 602 of the tool housing 110. The operating element 210 is then moved in the direction of the second region 314 of the opening 310, and thus of the second region 414 of the opening 410 from FIG. 4, the extent bB1 and the extent bG1 realizing the joint clearance.

Figure 7:
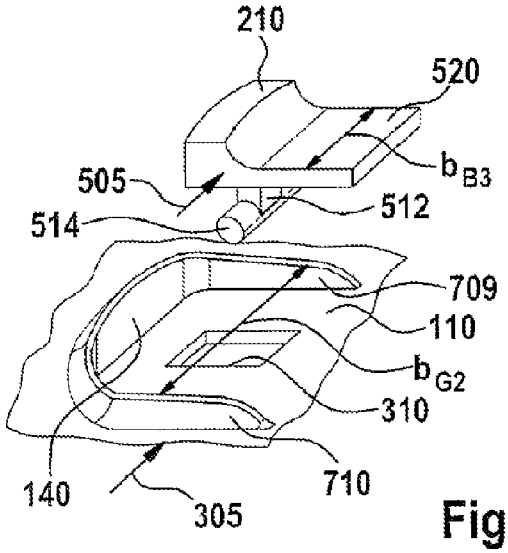

FIG. 7 shows the anti-rotation means 140 from FIG. 1, realized according to a second embodiment, which is preferably realized in such a manner that it realizes a joint clearance with the operating element 210 from FIG. 2 in the transverse direction 305 of the tool housing 110 from FIG. 3, and in the transverse direction 505 of the operating element 210 from FIG. 5. Preferably in this case, the operating element 210, or the actuating region 520 of the operating element 210 from FIG. 5, has an extent bB3, preferably realized as a width, in the transverse direction 505 of the operating element 210.

The anti-rotation means 140 according to the second embodiment preferably has a radial enlargement 710, which realizes a recess 709 having an extent bG2, preferably realized as a width, in the transverse direction 305 of the tool housing 110. Illustratively, the opening 310 of the tool housing 110 is rectangular in form, since rotation of the operating element 210 is at least limited by the anti-rotation means 140. Moreover, it is also possible for the anti-rotation means 140 according to the second embodiment to be combined with the anti-rotation means 140 realized according to the first embodiment.

Figure 8A:
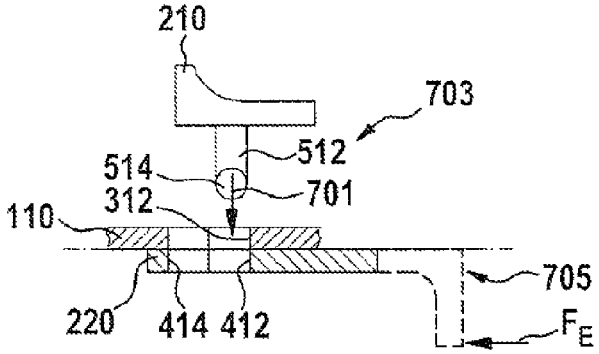

FIG. 8*a* shows the switching device 150 and the tool housing 110 from FIG. 1, wherein a sub-region of the tool housing 110, in which the opening 310 from FIG. 3 is arranged, is represented in a first region 703, and the switching device 150 is represented in a second region 705. FIG. 8*a* illustrates the mounting of the operating element 210 from FIG. 2, in which, preferably, the switching slide 220 is preferably subjected to an external mounting force $F_E$ in such a manner that the holding element 514 from FIG. 5 can be inserted through the receiver 410 of the switching slide 220 from FIG. 4 and the opening 310 of the tool housing 110 from FIG. 3, in the direction of an arrow 701. Preferably, the external mounting force $F_E$ causes receiver 410 to be arranged such that it is congruent with the opening 310.

Figure 8B:
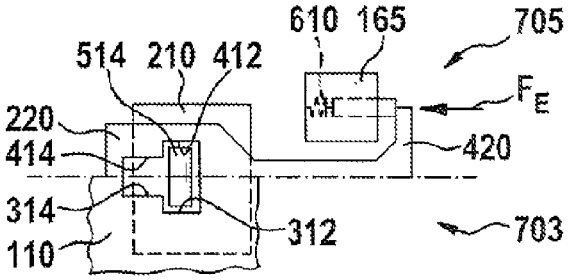

FIG. 8*b* shows an exemplary restoring spring 610, which is preferably arranged in the electric switch 165. FIG. 8*b* illustrates the congruent arrangement of the receiver 410 from FIG. 4 and of the opening 310 from FIG. 3, in or through the first regions 412, 312 of which the holding element 514 from FIG. 5 is arranged or inserted. The external mounting force $F_E$ is then removed from the switching slide 210, such that the latter, preferably as a result of a spring force ($F_S$ in FIG. 10*b*) that opposes the external mounting force $F_E$ and that is preferably generated by the restoring spring 610, moves into an off position, in which the connecting web 512 from FIG. 5 is arranged in the second region 414 of the receiver 410.

Figure 9A:
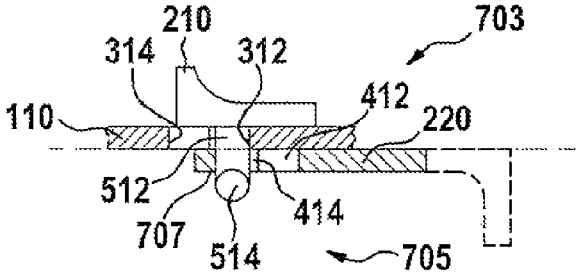

FIG. 9*a* shows the arrangement from FIG. 8*a* following mounting and with the drive motor 160 from FIG. 1 in the switched-off state, in which the operating element 210 has been fixed to the switching slide 210 from FIG. 2 and to the tool housing 110 from FIG. 1. Its connecting web 512 in this case is arranged in the second region 414 of the receiver 410 from FIG. 4 and the first region 312 of the opening 310 from FIG. 3, and its holding element 514 is arranged such that it is fixed to an underside 707 of the switching slide 220.

Figure 9B:
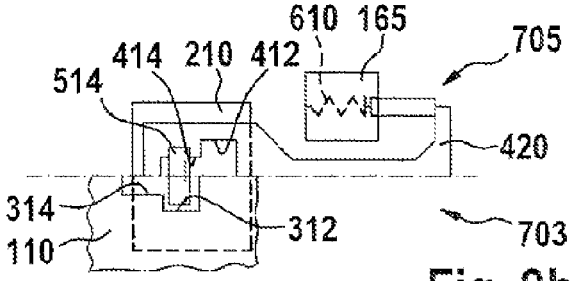

FIG. 9*b* shows the arrangement from FIG. 9*a*, the first region 703 being represented as a sub-region of the tool housing 110, having the opening 310, and the second region 705 comprising the switching device 150. When the drive motor 160 is in the switched-off state, the electric switch 165 is preferably not actuated, and in an assigned off position.

Figure 10A:
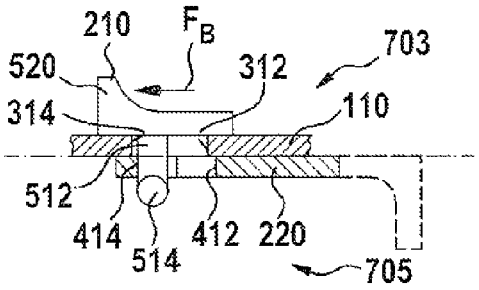

FIG. 10*a* shows the arrangement from FIG. 9*a*, with the drive motor 160 from FIG. 1 in the switched-on state, in which preferably a force $F_B$ applied to the operating element 520 by a user arranges the connecting web 512 in the second region 414 of the receiver 410 and the second region 314 of the opening 310, or displaces it into a corresponding on position.

Figure 10B:
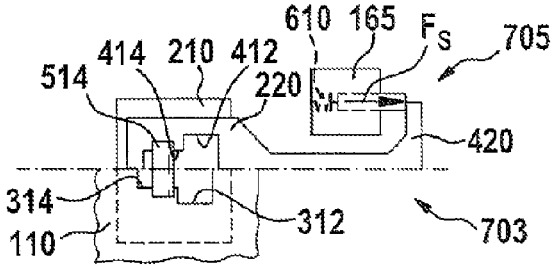

FIG. 10*b* shows the arrangement from FIG. 10*a*, the first region 703 being represented as a sub-region of the tool housing 110, comprising the opening 310, and the second region 705 comprising the switching device 150. When the drive motor 160 is in the switched-on state, the electric switch 165 is preferably actuated, and a restoring force $F_S$, by which the operating element 210 is held in the on position, in the second region 414 of the switching slide 220, is preferably exerted upon the actuating element 420 of the switching slide 210 by the restoring spring 610.

Figure 11:
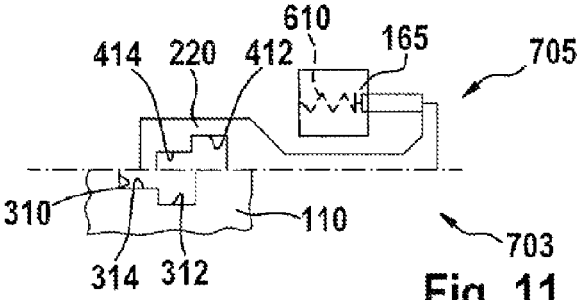

FIG. 11 shows the arrangement from FIG. 9*b* without the operating element 210, to illustrate the arrangement of the receiver 410 of the switching slide 220 relative to the opening 310 of the tool housing 110 when the drive motor 160 is in the switched-off state.

Figure 12:
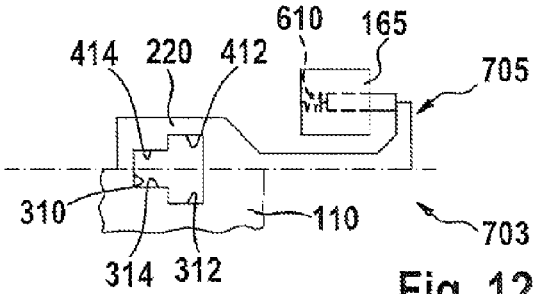

FIG. 12 shows the arrangement from FIG. 10*b* without the operating element 210, to illustrate the arrangement of the receiver 410 of the switching slide 220 relative to the opening 310 of the tool housing 110 when the drive motor is in the switched-on state.

Figure 13:
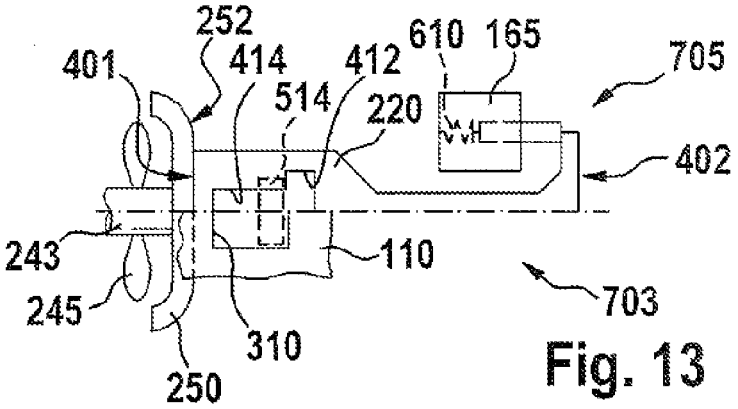

FIG. 13 shows the arrangement from FIG. 9*b*, with the opening 310 from FIG. 7 and the end stop 250 from FIG. 2. In FIG. 13, the end stop 250 is realized, illustratively, as an air guide ring 247, and is preferably arranged such that its side 252 that faces away from the fan 245 from FIG. 2 is in the region of the first axial end 401 of the switching slide 220.

Figure 14:
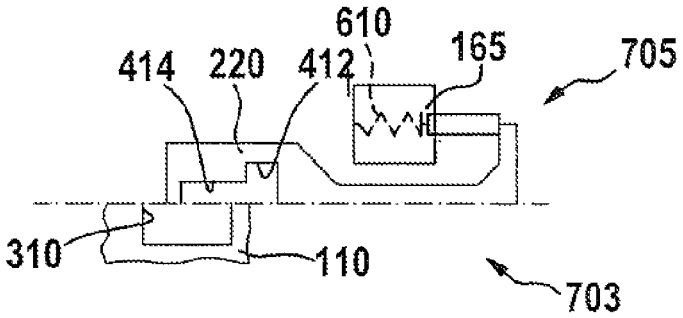

FIG. 14 shows the arrangement from FIG. 11, with the opening 310 from FIG. 7, which is preferably rectangular in form.

Figure 15:
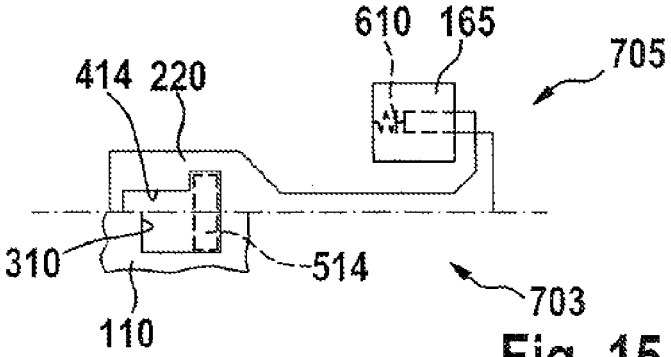

FIG. 15 shows the switching slide 220 from FIG. 2 in the mounting position from FIG. 8*b*, with the opening 310 from FIG. 7, preferably rectangular in form, which cannot be reached by the switching slide 220 through the end stop 250, when the drive motor 160, or the electric power tool 100, from FIG. 1 is in operation.

According to a further embodiment, the end stop 250 may be constituted by any component of the electric power tool 100 that limits the travel of the switching device 150 from FIG. 1 in such a manner that the mounting position of the operating element 210 cannot be reached by this during operation.

Figure 16:
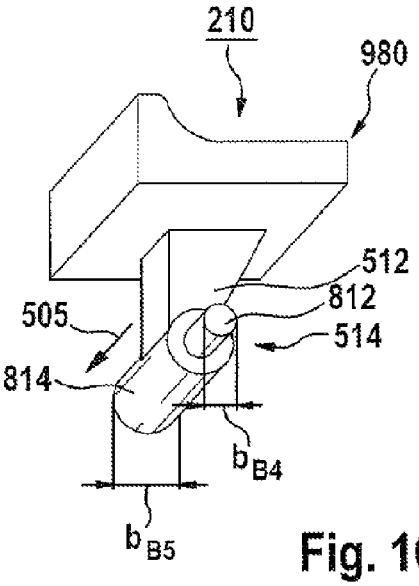

FIG. 16 shows the operating element 210 from FIG. 5 with a coding 980 for mounting in the correct position. According to one embodiment, the coding 980 has at least one width asymmetry and/or geometric asymmetry. For this purpose, illustratively, the holding element 514 of the operating element 210 from FIG. 5 has a first and a second region 812, 814 that, preferably in the radial direction, have a first and a second extent bB4, bB5, preferably realized as a diameter. Preferably, the first region 812 of the connecting web 512 from FIG. 5 is realized against the transverse direction 505 of the operating element 210, and the second region 814 in the transverse direction 505.

Figure 17:
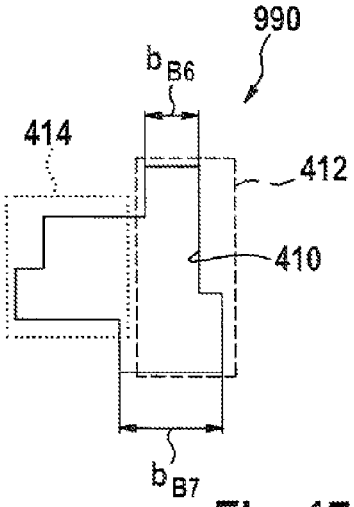

FIG. 17 shows the receiver 410 of the switching slide 220 from FIG. 2 with a coding 990 matched to the coding 980. Preferably, in the first region 412 of the receiver 410 from FIG. 4, the coding 990 has an extent bB6, bB7 that is preferably realized as a width. The first extent bB6 is matched to the extent bB4 of the first region 812 of the holding element 514, and the second extent bB7 is matched to the extent bB5 of the second region 814 of the holding element 514.

Figure 18:
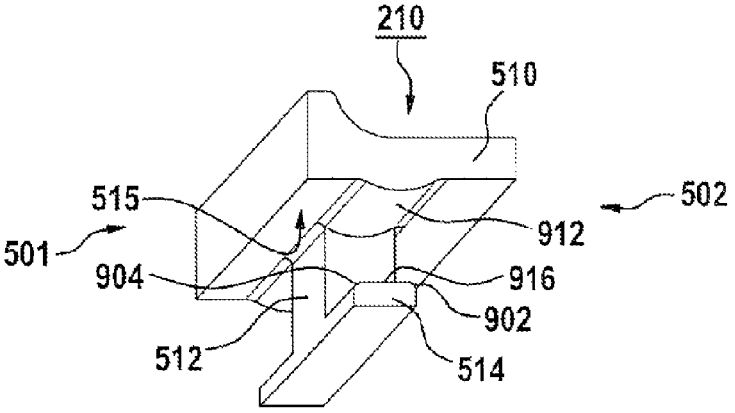

FIG. 18 shows the operating element 210 from FIG. 5, which on its underside 515 has at least one extent 912 having a preferably curved cross section, in order to improve the sliding property of the operating element 210 on the tool housing 110 from FIG. 1. Moreover, FIG. 18 illustrates a preferably rectangular cross section of the holding element 514, which preferably has a chamfer 902, 904 at least at one edge, illustratively at the edges of a side 916 of the cross section of the holding element 514 from FIG. 5 that faces toward the underside 515 of the operating element 210. The holding element 514, however, could be of any other shape.

What is claimed is:

1. An electric power tool, comprising:

a tool housing;

a drive motor arranged in the tool housing, the drive motor configured to drive an assigned insert tool;

an electric switch configured to switch on and off the drive motor; and a switching device configured to actuate the electric switch, the switching device having at least one switching slide arranged in a longitudinally displaceable manner on the tool housing, the at least one switching slide having a first axial end and a second axial end opposite the first axial end, wherein:

the first axial end of the at least one switching slide has at least one receiver configured to at least partially receive an operating element, the at least one receiver having at least one first region that tapers into at least one second region, the operating element having at least one connecting web connected to at least one holding element, the at least one holding element having, in a transverse direction of the operating element, an extent that is less than or equal to an assigned extent of the first region, and the connecting web having, in the transverse direction of the operating element, an extent that is less than or equal to an assigned extent of the second region, and the second axial end of the at least one switching slide is connected to an actuating element configured to actuate the electric switch.

2. The electric power tool according to claim 1, wherein the extent of the holding element is greater than the extent of the second region.

3. The electric power tool according to claim 1, wherein the at least one connecting web and the at least one holding element are at least approximately shaped as a T on a side of the operating element that faces toward the tool housing.

4. The electric power tool according to claim 1, wherein the at least one connecting web and the at least one holding element are integral with the operating element.

5. The electric power tool according to claim 1, wherein an end stop is provided to limit travel of the switching device in at least one of switching-on and switching-off the drive motor.

6. The electric power tool according to claim 1, wherein:

the operating element is configured to cooperate with the housing to prevent rotation of the operating element with respect to the tool housing.

7. The electric power tool according to claim 1, wherein:

the tool housing has an opening, the at least one connecting web is arranged at least partially in the opening, the opening has at least one first and one second region, and an extent of the second region, in a transverse direction of the tool housing, is configured to cooperate with the extent of the at least one connecting web, in the transverse direction of the operating element, to prevent rotation of the operating element with respect to the tool housing.

8. The electric power tool according to claim 7, wherein the opening and the at least one receiver have at least approximately matching dimensions.

9. The electric power tool according to claim 1, wherein the switching slide and the operating element have a coding configured to facilitate mounting the operating element on the switching slide in the correct position.

10. The electric power tool according to claim 9, wherein the coding has at least one of at least one width asymmetry and at least one geometric asymmetry.

11. The electric power tool according to claim 1, wherein a side of the operating element that faces toward the tool housing has at least one extent that has a curved cross section.

12. The electric power tool according to claim 1, further comprising: a restoring spring configured to exert a restoring force upon the switching device to prevent the operating element from separating from the switching slide.

13. The electric power tool according to claim 12, wherein the restoring spring is integrated into the electric switch.

14. The electric power tool according to claim 12, wherein the restoring spring is connected to the switching slide and the tool housing.

15. An electric power tool, comprising:

a tool housing;

a drive motor arranged in the tool housing, the drive motor configured to drive an assigned insert tool;

an electric switch configured to switch on and off the drive motor; and a switching device configured to actuate the electric switch, the switching device having at least one switching slide arranged in a longitudinally displaceable manner on the tool housing, the at least one switching slide having a first axial end and a second axial end opposite the first axial end, wherein:

the first axial end of the at least one switching slide has at least one receiver configured to at least partially receive an operating element, the at least one receiver having at least one first region that tapers into at least one second region, the operating element having at least one connecting web connected to at least one holding element, the at least one holding element having, in a transverse direction of the operating element, an extent that is less than or equal to an assigned extent of the first region, and the connecting web having, in the transverse direction of the operating element, an extent that is less than or equal to an assigned extent of the second region, the at least one connecting web and the at least one holding element are at least approximately shaped as a T on a side of the operating element that faces toward the tool housing, and the second axial end of the at least one switching slide is connected to an actuating element configured to actuate the electric switch.

16. An electric power tool, comprising:

a tool housing;

a drive motor arranged in the tool housing, the drive motor configured to drive an assigned insert tool;

an electric switch configured to switch on and off the drive motor; and a switching device configured to actuate the electric switch, the switching device having at least one switching slide arranged in a longitudinally displaceable manner on the tool housing, the at least one switching slide having a first axial end and a second axial end opposite the first axial end, wherein:

the first axial end of the at least one switching slide has at least one receiver configured to at least partially receive an operating element, the at least one receiver having at least one first region that tapers into at least one second region, the operating element having at least one connecting web connected to at least one holding element, the at least one holding element having, in a transverse direction of the operating element, an extent that is less than or equal to an assigned extent of the first region, and the connecting web having, in the transverse direction of the operating element, an extent that is less than or equal to an assigned extent of the second region, a side of the operating element that faces toward the tool housing has at least one extent that has a curved cross section, and the second axial end of the at least one switching slide is connected to an actuating element configured to actuate the electric switch.

* * * * *